US005709101A

United States Patent [19]

Jeong

[11] Patent Number: 5,709,101

[45] Date of Patent: Jan. 20, 1998

[54] COOLED AIR SUCTION DUCT FOR REFRIGERATOR

[75] Inventor: Gue Ho Jeong, Kyungsangnam-do, Rep. of Korea

[73] Assignee: LG Electronics Inc., Rep. of Korea

[21] Appl. No.: 582,494

[22] Filed: Jan. 3, 1996

[51] Int. Cl.[6] ..... F25D 21/14

[52] U.S. Cl. ..... 62/285; 62/288

[58] Field of Search ..... 62/285, 288

[56] References Cited

U.S. PATENT DOCUMENTS

| | | | |
|---|---|---|---|
| 2,982,115 | 5/1961 | Wurtz et al. | 62/288 |
| 3,280,583 | 10/1966 | Jones et al. | 62/285 |
| 3,310,957 | 3/1967 | Saunders et al. | 62/285 |
| 3,599,442 | 8/1971 | Hanson | 62/285 |
| 3,774,408 | 11/1973 | Pruehs | 62/285 |
| 3,868,829 | 3/1975 | Mann et al. | 62/285 |
| 5,388,427 | 2/1995 | Lee | 62/285 |

*Primary Examiner*—William E. Tapolcai

*Attorney, Agent, or Firm*—Ostrolenk, Faber, Gerb & Soffen, LLP

[57] ABSTRACT

An improved cooled air suction duct for refrigerator having a defrosted water receiving member integrally formed with a cooled air suction duct, thus improving the flow of the cooled air in the system and enhancing productivity, which includes a defrosted water receiving member disposed at a lower side of an evaporator for receiving a defrosted water; and a cooled air suction duct imbedded within an intermediate insulation wall for returning a cooled air to the evaporator, the cooled air suction duct being integral with the defrosted water receiving member.

10 Claims, 6 Drawing Sheets

COOLED AIR SUCTION DUCT FOR REFRIGERATOR

BACKGROUND OF THE INVENTION

1. Field of the Invention

The present invention relates to a cooled air suction duct for a refrigerator, and in particular to an improved cooled air suction duct for a refrigerator having a defrosted water receiving member integrally formed with a cooled air suction duct, thus improving the flow of the cooled air in the system and enhancing productivity.

2. Description of the Conventional Art

FIG. 1 shows a conventional refrigerator, which includes an intermediate insulation wall for dividing the interior of the refrigeration into two parts.

A freezing compartment 3 is formed at the upper side of the refrigerator and a refrigerating compartment 4 is formed at the lower side of the refrigerator.

An evaporator 6 is disposed at the rear portion of the refrigerator for exchanging heat between the system and the outside thereof. A fan unit 5 is disposed above the evaporator 6 for flowing cooled air into the freezing compartment 2 and the refrigerating compartment 4.

In addition, a temperature controller 7 is disposed at a predetermined inner upper portion of the refrigerator 4.

Meanwhile, a cooled air suction duct 8, as shown in FIGS. 2 and 3, is embedded within an inner casing 12 consisting of the intermediate insulation wall 2 for guiding the circulating cooled air from the refrigerating compartment 4 to the evaporator.

In addition, an intermediate insulation wall 2 into which a foamed insulation material is filled is formed between the inner casing 12 and the cooled air suction duct 20.

Meanwhile, a defrosted water receiving member 13 is provided at the lower portion of the evaporator 6 for receiving the defrosted water therein and is spaced-apart from the cooled air suction duct 8. One side of the defrosted water receiving member 13 contacts with one side wall of the cooled air suction duct 8. In addition, the defrosted water receiving member 13 and the cooled air suction duct 8 are coated by sealants.

In addition, a defrosted water discharging member (not shown) is provided at the lower portion of the defrosted water receiving member 13 for receiving the defrosted water from the evaporator 6 and for discharging to the outside of the refrigerator body 1.

In the drawings, reference numeral 9 denotes a freezing compartment door, and 9*a* denotes a freezing compartment door grip, and 10 denotes a refrigerating compartment door, and 10*a* denotes a refrigerating compartment door grip.

The operation of the conventional refrigerator will now be explained with reference to the accompanying drawings.

To begin with, when the fan unit 5 is driven, air is introduced from the outside of the refrigerator body 1 into the interior of the same, and the thusly introduced air is cooled while passing through the evaporator 6 by the heat exchanging operation.

In addition, the air which is not introduced into the freezing compartment 3 is introduced into the interior of the refrigerating compartment 4 through a refrigerating compartment outlet duct (not shown).

At this time, the temperature controller 7 controls the mount of air supplied to the refrigerating compartment 4 and the temperature of the refrigerating compartment 4 to be a certain temperature.

The air introduced into the interior of the refrigerating compartment 4 is heat-exchanged with the air in the interior of the refrigerating compartment 4 and the temperature of the same is increased. The air having a high temperature is introduced into the cooled air suction duct 8 embedded within the intermediate insulation wall 2 in cooperation with the rotation force of the fan and introduced to the evaporator 6, so that the air having a high temperature is changed to the cooled air.

That is, the freezing compartment 3 and the refrigerating compartment become cooled by the cooled air introduced thereto.

Meanwhile, the construction of another conventional cooled air suction duct for a refrigerator will now be explained.

As shown in FIGS. 4 and 5, a freezing compartment cooled air suction duct 28 and a refrigerating compartment cooled air suction duct 38 are disposed at an intermediate insulation wall 22.

In addition, in order to assembly the system, the intermediate insulation wall 22 provided with the freezing compartment cooled air suction duct 28 and the refrigerating compartment cooled air suction duct 38 is fit with the entrances of a cooled air suction port 28*a* and a cooled air suction duct 28, and a cooled air suction port 38*a* formed at the side of the refrigerating compartment 23 is fit with the entrance of the cooled air suction duct 38.

In addition, the defrosted water receiving member 33 of refrigerator is directed to receiving the defrosted water and introducing to the defrosted water gathering container (not shown) disposed below the refrigerating compartment 20.

The air flow of the another conventional refrigerator will now be explained.

When the refrigerator is driven, air is introduced into the refrigerator, and is cooled while passing through an evaporator 34 and is supplied to the freezing compartment 23.

The thusly cooled air is circulated inside the refrigerator and is transferred to the evaporator 34 through the cooled air suction duct 28 connected to the lower portion of the freezing compartment 23.

In addition, the air is introduced into the refrigerating compartment 24 through the refrigerating compartment outlet duct (not shown) and discharged to the evaporator 34 through the refrigerating compartment suction duct 38.

As above-described above, the air is circulated within the freezing compartment 23 and the refrigerating compartment 24, so that a desired effect can be achieved in the refrigerator.

However, the conventional cooled air suction duct of refrigerator has disadvantages in that since the cooled air suction duct for returning the cooled air circulated within the refrigerating compartment to the evaporator and the defrosted water receiving member are separately provided therein, a process of sealing the boundary therebetween should be additionally provided, so that workability is decreased.

In addition, when using refrigerator for long time, since the sealing effect is reduced, a certain gap is formed at the boundary therebetween, thus causing water leakage.

Moreover, since the intermediate insulation wall is not fixed to the refrigerator body, when insulation material is filled into the wall, the foamed liquid is protruded from the inner surface of the duct, so that the air flow interferes with the insulation material protrusions. In addition, since the freezing compartment cooled air suction duct and the refrigerating compartment cooled air suction duct are not accurately connected with the freezing compartment and refrigerating compartment, respectively, a desired cooled air flow cannot be achieved.

Moreover, since the freezing compartment cooled air suction and refrigerating compartment cooled air suction are not effectively insulated, water drops are formed therebetween due to temperature differences therebetween, so that the icing phenomenon occurs therein, and a desired cooled air flow cannot be achieved, causing malfunctions of the refrigerator.

SUMMARY OF THE INVENTION

Accordingly, it is an object of the present invention to provide a cooled air suction duct for refrigerator, which overcome the problems encountered in a conventional cooled air suction duct for refrigerator.

It is another object of the present invention to provide an improved cooled air suction duct for a refrigerator having a defrosted water receiving member integrally formed with a cooled air suction duct, thus improving the flow of the cooled air in the system and enhancing productivity.

To achieve the above objects, there is provided a cooled air suction duct for refrigerator, which includes a defrosted water receiving member disposed at a lower side of an evaporator for receiving a defrosted water; and a cooled air suction duct imbedded within an intermediate insulation wall for returning a cooled air to the evaporator, the cooled air suction duct being integral with the defrosted water receiving member.

DETAILED DESCRIPTION OF THE INVENTION

The construction of the cooled air suction duct for a refrigerator of a first embodiment according to the present invention will now be explained with reference to the accompanying drawings.

To begin with, since the entire construction of the refrigerator of this embodiment is the same as the conventional art, only the different construction will now be explained.

Figure 1:
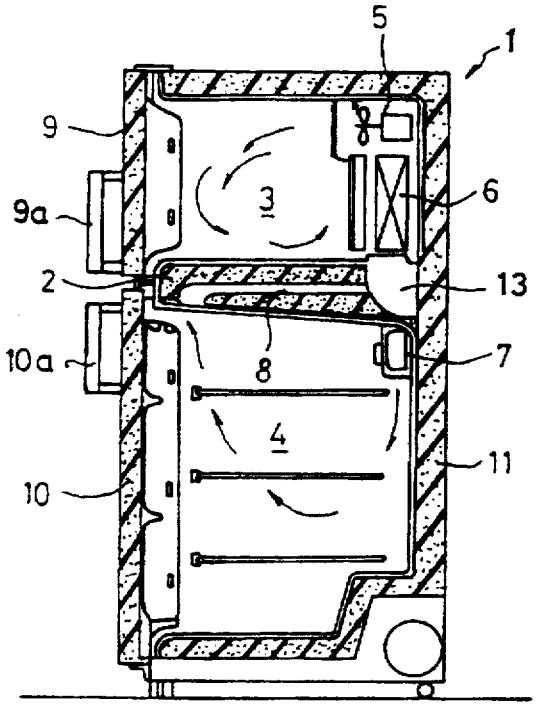
FIG. 1 CONVENTIONAL ART
FIG. 1 is a cross-sectional view of a conventional refrigerator.
Figure 2:
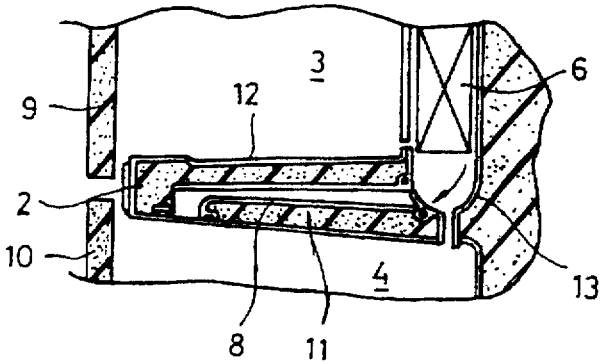
FIG. 2 CONVENTIONAL ART
FIG. 2 is an enlarged cross-sectional view showing an intermediate insulation wall provided with a cooled air duct of a conventional refrigerator.
Figure 3:
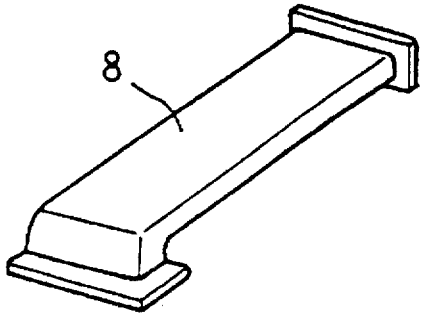
FIG. 3 CONVENTIONAL ART
FIG. 3 is a perspective view showing a cooled air suction duct embedded within an intermediate wall of a conventional refrigerator.
Figure 4:
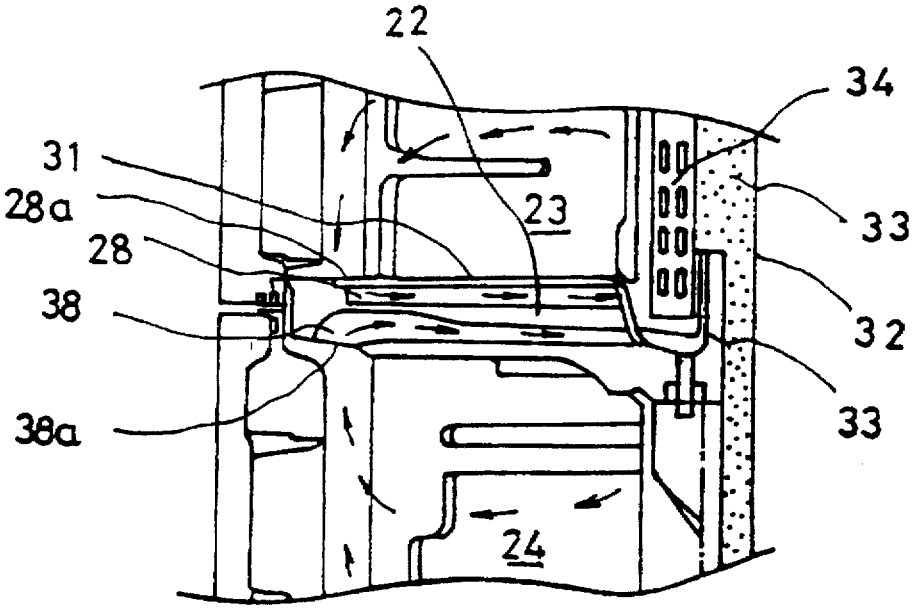
FIG. 4 CONVENTIONAL ART
FIG. 4 is a partial cross-sectional view showing an intermediate insulation wall equipped with a cooled air suction duct of another conventional refrigerator.
Figure 5:
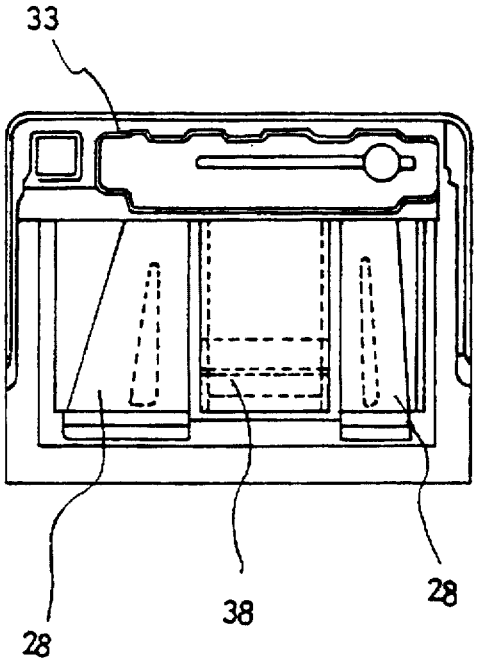
FIG. 5 CONVENTIONAL ART
FIG. 5 is a cross-sectional view showing a cooled air suction duct of another conventional refrigerator.
Figure 6:
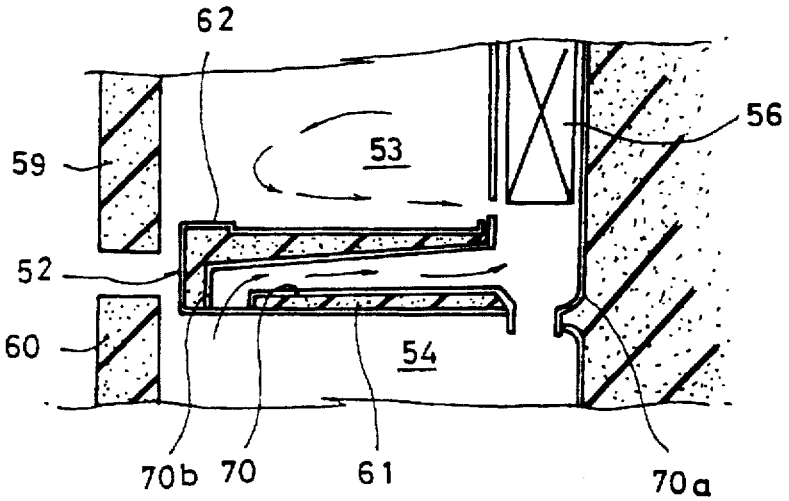
FIG. 6 is a partially enlarged cross-sectional view showing an intermediate insulation wall provided with a cooled air suction duct of a refrigerator of a first embodiment according to the present invention.

FIG. 6 shows a cooled air suction duct of the present invention, which includes a defrosted water receiving member 70*a* disposed at the lower portion of an evaporator 56 for receiving the defrosted water and a cooled air suction duct 70*b* embedded within an intermediate insulation wall 52 for returning the cooled air of the refrigerating compartment 54 to an evaporator 56. Here, the defrosted water receiving member 70 and the cooled air suction duet 70*b* are integrally formed.

Figure 7:
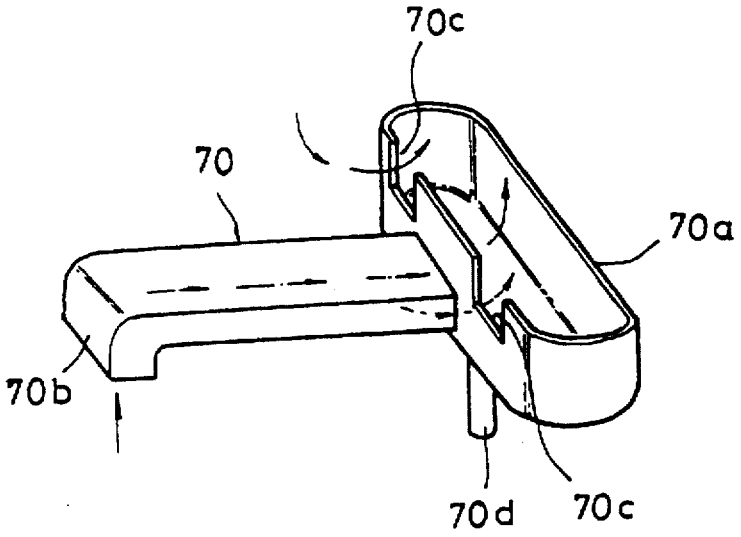
FIG. 7 is a perspective view of a cooled air suction duct of a refrigerator of a first embodiment according to the present invention.

In addition, as shown in FIG. 7, a circulating air suction member 70*c* is formed at both inner upper ends of the defrosted water receiving member 70*a*.

Therefore, the air circulated within the refrigerating compartment is returned to the lower side of the evaporator 56 through the circulating air suction member 70*c*.

The air introduced to the circulating air suction member 70*c* is circulated within the refrigerating compartment 54 and, the air circulated within the freezing compartment 53 introduced through the circulating air suction member 70*c* is heat-exchanged at a marginal portion of the evaporator 56, in which heat exchange is not performed well, because the temperature of the air introduced to the circulating air suction member 70*c* is lower than that of the air introduced into the interior of the cooled air suction duct member 7O*b*.

Meanwhile, the air circulated within the refrigerating compartment 54 having a relatively high temperature is heat-exchanged at the central portion of the evaporator 56 in which the heat exchange is well performed, so that efficiency of the evaporator 56 is increased.

Meanwhile, a defrosted water discharging member 70*d* is formed at the lower portion of the defrosted water receiving member 70*a* for discharging the defrosted water generated from the evaporator 56 to the outside of the refrigerator.

Generally, in order to fabricate the cooled air suction duct, a blow molding type molding has been adopted in the industry. This process will now be explained with reference to the accompanying drawings.

Figure 8:
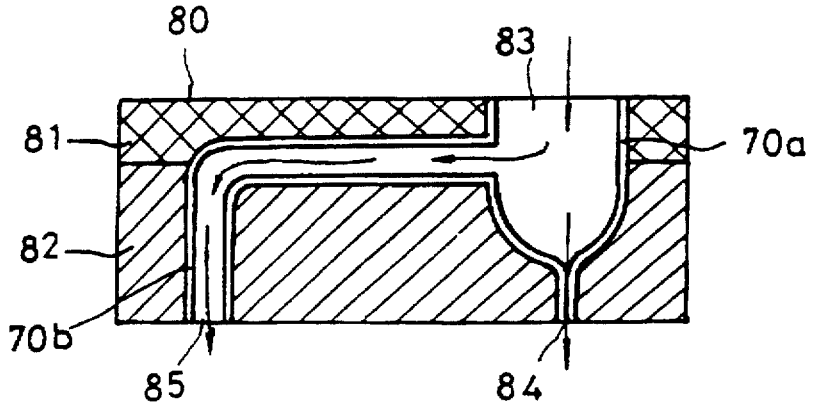
FIG. 8 is a cross-sectional view so as to describe a fabrication process of a cooled air suction duct of a refrigerator of a first embodiment according to the present invention.

As shown in FIG. 8, a cooled air suction duct 70*b* and a defrosted water receiving member 70*a* are integrally molded within a mold 80. Thereafter, upper and lower members 81 and 82 are fit to each other. In the above-mentioned state, a jelly type plastic mass is introduced into the mold 80 with a predetermined air pressure through an air port 83, and a central path is formed, and the plastic mass is formed to be the same inner surface shape of the upper and lower members 81 and 82.

Thereafter, the mold 80 is hardened by decreasing the temperature thereof, and the upper and lower members 81 and 82 are separated, and an integral type duct can be fabricated thereby by cutting unnecessary portion thereof.

The thusly-fabricated cooled air suction duet 70, as shown in FIG. 6, is inserted into the interior of the inner easing 62 of the intermediate insulation wall 52, and a foamed insulation material 61 is filled between the inner casing 62 and the cooled air suction duct 70, and the intermediate insulation wall 52 is formed.

Figure 9:
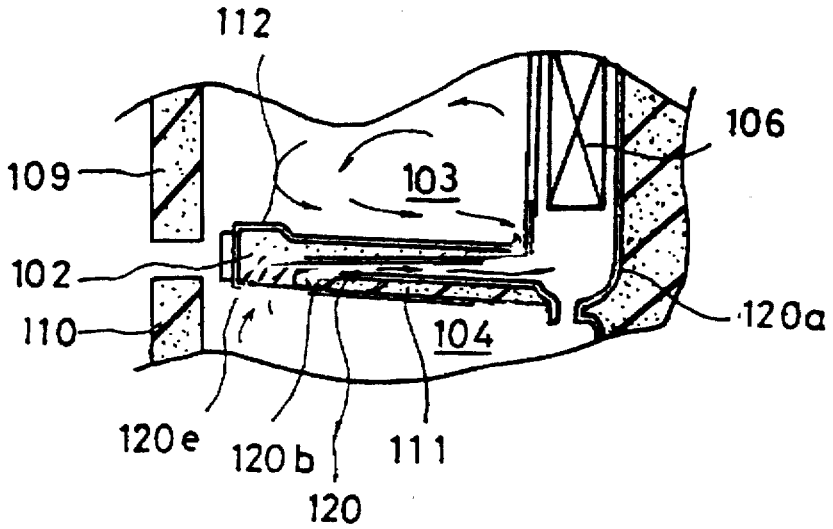
FIG. 9 is a partially enlarged cross-sectional view showing an intermediate insulation wall provided with a cooled air suction duct of a refrigerator of a second embodiment according to the present invention.
Figure 10:
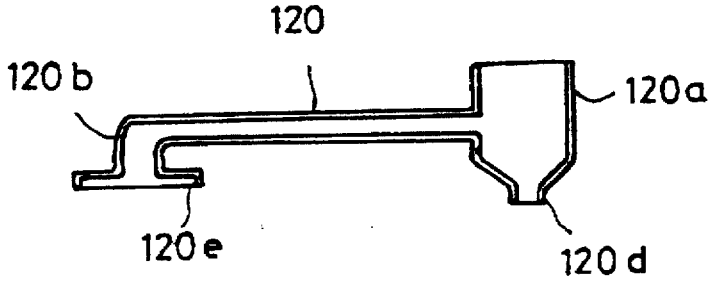
FIG. 10 is a cross-sectional view of a cooled air suction duct of a second embodiment according to the present invention.

Meanwhile, FIGS. 9 and 10 show a cooled air suction duct for refrigerator of a second embodiment according to the present invention, which is directed to minimizing air flow resistance at the entrance of a cooled air suction duct 120 for a better cooled air flow, wherein an extended portion **120*e* is formed at the entrance of the cooled air suction duct 120 and the air circulated within the refrigerating compartment 104. That is, this embodiment is directed to minimizing the air flow resistance at the entrance of the cooled air suction duct 120**.

Since the operation and fabrication process of the second embodiment according to the present invention is the same as the first embodiment, the description with respect thereto will now be omitted.

In the drawings, reference numeral 102 denotes an intermediate insulation wall, 103 denotes a freezing compartment, 106 denotes an evaporator, 109 denotes a refrigerating door, 110 denotes a refrigerating compartment door, 111 denotes a foamed insulation material, 112 denotes an inner casing, **102*a* denotes a defrosted water receiving member, 120*b* denotes a cooled air suction duct, 120*d*** denotes a defrosting section.

Figure 11:
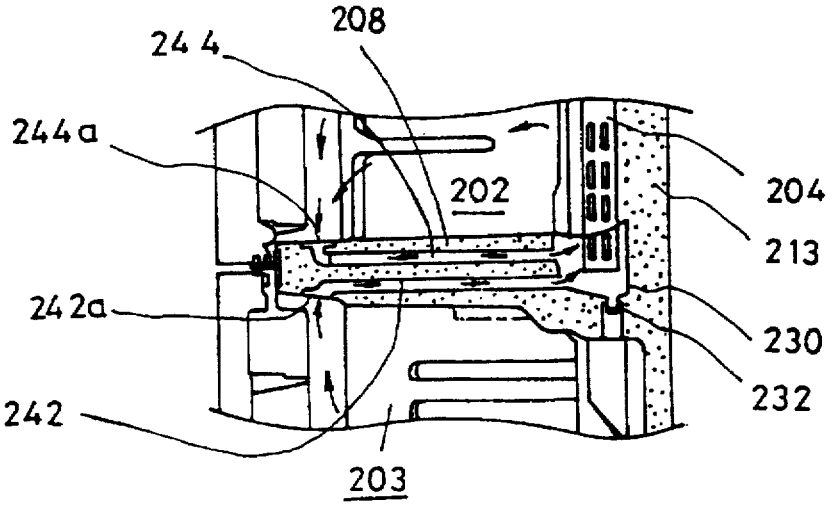
FIG. 11 is a cross-sectional view of an intermediate wall provided with a cooled air suction duct of a refrigerator of a third embodiment according to the present invention.
Figure 12:
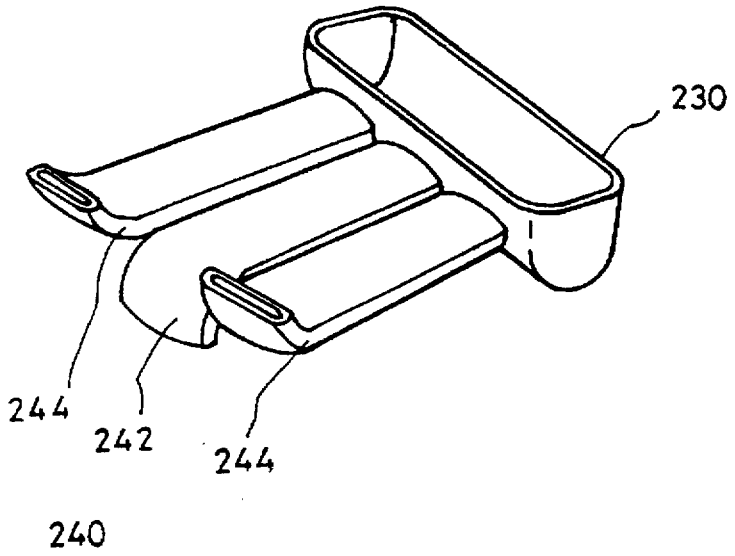
FIG. 12 is a perspective view showing a cooled air suction duct of a third embodiment according to the present invention.

FIGS. 11 and 12 show a cooled air suction duct for a refrigerator of a third embodiment according to the present invention, which is directed to integrally forming a defrosted water receiving member 230 and a cooled air suction duct 240.

In addition, a curved end of a refrigerating compartment cooled air suction duct 242 is connected to the defrosted water receiving member 230 and engaged to a cooled air suction port **242*a* formed in the refrigerating compartment 203**.

Therefore, the refrigerating compartment cooled air suction duct 242 sucks air discharged from the refrigerating compartment 203 and guides the air to flow toward the evaporator 204 through the defrosted water receiving member 230.

However, in this embodiment, since the cooled air suction duct includes a freezing compartment cooled air suction duct 244 which is parallel to both sides of the refrigerating compartment cooled air suction duct 242 and passes through one side of the defrosted water receiving member 230.

In addition, since the end portion of the freezing compartment suction duet 244 is upwardly formed and inserted into a cooled air suction port **244*a* formed in the freezing compartment 202**.

Therefore, the freezing compartment cooled air suction duct 244 sucks the cooled air discharged from the freezing compartment 202 and supplies to the evaporator 204 through the defrosted water receiving member 230.

The cooled air suction duct of this embodiment are formed in the same method of the first and second embodiments according to the present invention.

The assembling process of fitting a cooled air suction duct to the refrigerator body is as follows.

To begin with, the cooled air suction duct 240 integrally formed with the defrosted water receiving member 230 is mounted at an intermediate portion of the refrigerator body, and an end portion of the freezing compartment cooled air suction duct 244 is inserted into a freezing compartment cooled air suction port **244*a* formed in the freezing compartment 202, and an end portion of the refrigerating compartment cooled air suction duct 242 is inserted into a refrigerating compartment cooled air suction port 244*a* formed in the refrigerating compartment 203, and a foamed insulation material 213** is covered on an outer plate (not shown).

The air flow in the refrigerator of the third embodiment according to the present invention will now be explained.

When a fan apparatus is driven, air is introduced into a freezing compartment of the refrigerator from the outside of the same, and is cooled while the air passes through an evaporator 202.

The cooled air is circulated within the freezing compartment 202 and the refrigerating compartment 203 and introduced into the freezing compartment cooled air suction duct 242 and the refrigerating compartment cooled air suction duct 244 through the freezing compartment cooled air suction port **244*a* of the freezing compartment 202 and the refrigerating compartment cooled air suction port 242*a* of the refrigerating compartment 203**.

The thusly sucked cooled air flows toward the evaporator 204 through the freezing compartment cooled suction air duct 242, the refrigerating compartment cooled air suction duct 244, and the defrosted water receiving member 230, so that the heat exchanging operation is performed.

In addition, the thusly heat-exchanged cooled air is circulated within the refrigerator.

As described above, the cooled air suction duct for a refrigerator is directed to directed to integrally forming the defrosted water receiving member disposed at the lower portion of the evaporator and the cooled air suction duct embedded within the interior of the intermediate insulation wall for returning the cooled air of the refrigerating and freezing compartments to the evaporator, so that sealing with respect to the boundary therebetween is not necessary, thus increasing workability and lengthening span of the product.

In addition, since an end portion of the cooled air suction duct is inserted into the cooled air suction port, when inserting the foamed insulation material thereinto, it is possible to prevent the protrusion of the insulation material. In addition, since the insulation material directly contact with the cooled air suction duct and the insulation material are substantially filled thereinto, so that a desired insulation effect can be achieved. Moreover, it is possible to prevent water drops formation in the duct caused by a moisture generation due to the temperature difference between the temperatures in the freezing compartment and the refrigerating compartment, thus lengthening the product's span of life.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A cooled air suction duct for a refrigerator, comprising:

a defrosted water receiving member disposed at a lower side of an evaporator for receiving defrosted water; and a cooled air suction duct embedded within an intermediate insulation wall for returning cooled air to said evaporator, said cooled air suction duct being integral with said defrosted water receiving member, wherein said defrosted water receiving member includes a circulating air suction member disposed at first and second ends of the defrosted water receiving member guiding air from a refrigerating compartment.

2. The duct of claim 1, wherein said cooled air suction duct includes an extended portion formed at the entrance thereof.

3. The duct of claim 1, wherein said cooled air suction duct is provided with a foamed insulation material provided at a periphery of the outer surface of the cooled air suction duct, so that the cooled air suction duct and said foamed insulation material directly contact.

4. A cooled air suction duct for a refrigerator, comprising:

a defrosted water receiving member disposed at a lower side of an evaporator for receiving defrosted water; and a cooled air suction duct embedded within an intermediate insulation wall for returning cooled air to said evaporator, said cooled air suction duct being integral with said defrosted water receiving member, wherein said cooled air suction duct includes:

a refrigerating compartment cooled air suction duct passing through one side of the defrosted water receiving member, said refrigerating compartment cooled air suction duct having an interior connected to the defrosted water receiving member; and a plurality of freezing compartment cooled air suction ducts passing through one side of the defrosted water receiving member, said freezing compartment cooled air suction ducts being parallel to both sides of the refrigerating compartment cooled air suction duct.

5. The duct of claim 4, wherein said refrigerating compartment cooled air suction duct includes a downwardly curved end portion.

6. The duct of claim 5, wherein said downwardly curved end portion of the refrigerating compartment cooled air suction duct is engaged to a cooled air suction port formed in a refrigerating compartment.

7. The duct of claim 4, wherein said freezing compartment cooled air suction duct includes a upwardly curved end portion.

8. The duct of claim 7, wherein said upwardly curved end portion of the freezing compartment cooled air suction duct is engaged to a cooled air suction port formed in a freezing compartment.

9. A cooled air suction duct for a refrigerator, comprising:

a defrosted water receiving member disposed at a lower side of an evaporator for receiving defrosted water;

a cooled air suction duct embedded within an intermediate insulation wall for returning cooled air to said evaporator, said cooled air suction duct being integral with said defrosted water receiving member, and wherein an outer portion of said freezing compartment cooled air suction duct and said refrigerating compartment cooled air suction duct is provided with a foamed insulation material, so that the freezing compartment cooled air suction duct, the refrigerating compartment cooled air suction duct, and said foamed insulation material directly contact with each other.

10. An insulation wall assembly of a refrigerator, comprising:

an outer casing;

an inner casing made by vacuum molding an ABS material formed integrally within said outer casing to separately form a freezer compartment and a refrigeration compartment;

an intermediate insulation wall formed at a middle portion of said inner casing for further separating said freezer compartment from said refrigeration compartment, said intermediate insulation wall having a suction duct with a suction opening at one end thereof for receiving cooled air circulating within said freezer compartment or said refrigeration compartment, said suction opening and suction duct both being formed integrally within said intermediate insulation wall by blow molding;

a defrosted water receiving device located at an end of said suction duct opposite said suction opening for receiving and removing defrosted water from an evaporator in said refrigerator; and an insulating foam material disposed between said inner casing and said suction duct.

* * * * *